US010041647B2

(12) United States Patent
Quadri et al.

(10) Patent No.: US 10,041,647 B2
(45) **Date of Patent: *Aug. 7, 2018**

(54) STAGE LIGHT FIXTURE

(71) Applicant: CLAY PAKY S.P.A., Seriate (IT)

(72) Inventors: Pasquale Quadri, Torre de' Roveri (IT); Francesco Campetella, Pesaro (IT)

(73) Assignee: CLAY PAKY S.P.A., Seriate (IT)

( * ) Notice: Subject to any disclaimer, the term of this patent is extended or adjusted under 35 U.S.C. 154(b) by 40 days.

This patent is subject to a terminal disclaimer.

(21) Appl. No.: 14/909,400

(22) PCT Filed: Aug. 12, 2014

(86) PCT No.: PCT/IB2014/063882
§ 371 (c)(1),
(2) Date: Feb. 1, 2016

(87) PCT Pub. No.: WO2015/022645
PCT Pub. Date: Feb. 19, 2015

(65) Prior Publication Data

US 2016/0195237 A1 Jul. 7, 2016

(30) Foreign Application Priority Data

Aug. 12, 2013 (IT) ..... MI2013A1386

(51) Int. Cl.
*F21V 14/02* (2006.01)
*F21V 14/06* (2006.01)
(Continued)

(52) U.S. Cl.
CPC ..... *F21V 5/04* (2013.01); *F21V 5/007* (2013.01); *F21V 5/02* (2013.01); *F21V 7/0083* (2013.01);
(Continued)

(58) Field of Classification Search
CPC ... F21V 5/04; F21V 5/007; F21V 5/02; F21V 7/0083; F21V 14/02; F21V 14/04; F21V 14/06; F21Y 2115/10; F21W 2131/406
See application file for complete search history.

(56) References Cited

U.S. PATENT DOCUMENTS

D315,222 S * 3/1991 Sanborn ..... D26/118
7,226,185 B2 * 6/2007 Dolgin ..... G02B 3/00 362/239
(Continued)

FOREIGN PATENT DOCUMENTS

DE 20 2009 01150 12/2010
EP 2 309 296 4/2011
EP 2 431 655 3/2012

*Primary Examiner* — Alexander Garlen
(74) *Attorney, Agent, or Firm* — Leason Ellis LLP

(57) ABSTRACT

A stage light fixture is provided with:
a plurality of light sources configured to emit respective light beams along respective optical axes;
a plurality of optical elements, each of which is configured to modify the direction of the rays defining the light beam of a respective light source; the optical elements being shaped and arranged one next to the other so as to define a total emission area of the light beams having an emission outline; the plurality of optical elements comprising at least two optical elements having different shape one with respect to the other.

18 Claims, 3 Drawing Sheets

(51) Int. Cl.

| | |
|---|---|
| ***F21V 5/00*** | (2018.01) |
| ***F21V 5/02*** | (2006.01) |
| ***F21V 5/04*** | (2006.01) |
| ***F21V 7/00*** | (2006.01) |
| *F21V 14/04* | (2006.01) |
| *F21W 131/406* | (2006.01) |
| *F21Y 115/10* | (2016.01) |

(52) U.S. Cl.
CPC ..... *F21V 14/02* (2013.01); *F21V 14/06* (2013.01); *F21V 14/04* (2013.01); *F21W 2131/406* (2013.01); *F21Y 2115/10* (2016.08)

(56) References Cited

U.S. PATENT DOCUMENTS

| | | | | |
|---|---|---|---|---|
| D744,156 | S * | 11/2015 | Kjaergaard Toft | D26/120 |
| 2010/0061090 | A1* | 3/2010 | Bergman | F21V 5/007 362/231 |
| 2011/0063836 | A1* | 3/2011 | Salm | F21V 5/04 362/235 |
| 2012/0091917 | A1* | 4/2012 | Vinther | F21S 10/023 315/312 |
| 2012/0121244 | A1 | 5/2012 | Stavely | |
| 2012/0140463 | A1 | 6/2012 | Kinzer et al. | |
| 2012/0155102 | A1* | 6/2012 | Melzner | F21V 5/002 362/510 |
| 2012/0212965 | A1* | 8/2012 | Nakamura | F21V 13/04 362/311.09 |
| 2012/0319616 | A1 | 12/2012 | Quilici et al. | |
| 2013/0170182 | A1 | 7/2013 | Hsieh et al. | |
| 2014/0301071 | A1* | 10/2014 | Jorgensen | F21V 14/06 362/231 |

* cited by examiner

STAGE LIGHT FIXTURE

CROSS REFERENCE TO RELATED APPLICATIONS

The present application is a U.S. National Phase of International Patent Application PCT/IB2014/063882, filed on Aug. 12, 2014, which claims priority to Italian Application No. MI2013A001386, filed on Aug. 12, 2013, each of which is incorporated by reference as if expressly set forth in their respective entireties herein.

TECHNICAL FIELD

The present invention relates to a stage light fixture. In particular, the present invention relates to a multisource stage light fixture.

BACKGROUND ART

Multisource stage light fixtures are known comprising a casing having a first closed end and a second end provided with a substantially circular section projection opening; a plurality of light sources uniformly distributed inside the casing and configured to emit respective light beams; and a plurality of lenses, each of which is configured to modify the direction of the rays defining the light beam of a respective light source.

The lenses are normally shaped and arranged so as to define an emission area of the light beams having a determined beam emission outline.

The emission area is defined by the sum of the emission areas of each single lens, while the emission outline is defined by the peripheral lenses, which substantially define the shape of the outline of the emission area.

The lenses of stage light fixtures of known type are normally either hexagonal or round and are supported by a frame.

The use of hexagonal lenses implies substantially two disadvantages. A first disadvantage is due to a loss in terms of efficiency, because the arrangement of the hexagonal lenses one next to the other defines an emission area which is much smaller than the available surface defined by the circular section projection opening of the casing. Indeed, a large portion of the available surface is occupied by the supporting frame.

The solutions of this type normally define an emission area equal to 79% of the available defined by the circular section projection opening of the casing.

Secondly, by looking at the stage light fixture frontally, the observer perceives a beam having a hexagonal-shaped emission outline, also at a given distance from the stage light fixture, despite the stage light fixture having a substantially round projection opening.

The use of the round lenses determines a further reduction of the efficiency of the stage light fixture. With the use of the round lenses, the inactive space between one lens and the other is greater than in the solution with hexagonal lenses.

Furthermore, by looking at the stage light fixture frontally, the observer perceives a set of emission points separate one with respect to the other even at a given distance from the stage light fixture.

A known solution requires to use round lenses supported by a frame which is transparent to light radiation. Such a solution solves the problem related to the perception of a set of distinct emission points. However, the problem related to the efficiency of the stage light fixture and to the insufficient exploitation of the available surface defined by the projection opening remains. Indeed, the transparent frame does not contribute to increasing the emission area because it is substantially inactive from the optical point of view and not controllable. The transparent frame cannot modify the tilt inclination of the light beam rays. The emission area in this case is substantially identical to the emission area of the solution having only round lenses and in which the frame is not made of transparent material.

DISCLOSURE OF INVENTION

It is thus the object of the present invention to make a stage light fixture which is free from drawbacks of the prior art illustrated above; in particular, it is an object of the invention to make a stage light fixture capable of optimizing the efficiency of the stage light fixture and exploiting available surface defined by the projection opening as much as possible.

In accordance with such objects, the present invention relates to a stage light fixture comprising:

a plurality of light sources configured to emit respective light beams along respective optical axes; a plurality of optical elements, each of which is configured to modify the direction of the rays of the light beam of a respective light source; each optical element being provided with an emission face having a respective emission area; the optical elements being shaped and arranged one next to the other so as to define a total emission area of the light beams having an emission outline; the plurality of optical elements comprising at least two optical elements having respective emission faces having different shape one from the other.

By virtue of the fact that at least two optical elements have different shape, the available surface defined by the projection opening of the casing, which is generally circular, can be best exploited, and the emission area defined by the sum of the emission areas of the plurality of optical elements can be increased.

This guarantees an increase of efficiency of the stage light fixture with respect to the prior art.

Indeed, the performance of the stage light fixture according to the present invention is better than the stage light fixtures of the prior art in which all the optical elements have the same shape (round or hexagonal etc.).

In particular, the luminance of the stage light fixture according to the present invention, the diameter of the projection opening and a number optical elements used being equal, is 30% greater than in the solution with round lenses and 22% greater than in the solution with hexagonal lenses.

In particular, for a stage light fixture according to the present invention having thirty-seven light sources and a projection opening having diameter of 335 mm, the luminance is approximately 20155 Lux. For a stage light fixture having the same number of sources and a projection opening having the same diameter, the luminance is approximately 17897 Lux, while with round lenses the luminance is approximately 14214 Lux.

According to a preferred embodiment of the present invention, the plurality of optical elements comprises a perimeter assembly of optical elements, arranged one next to the other to define an outline of the emission area.

In this manner, the outline of the emission area is defined by the perimeter assembly of optical elements and may be simply modified by modifying the shape of the optical elements of the perimeter assembly.

According to a preferred embodiment of the present invention, the optical elements of the perimeter assembly are shaped so as to define an outline of the emission area which approximates a circumference. In this manner, by looking at the stage light fixture frontally, the observer perceives an emission area having a substantially circular outline. Furthermore, the fact that the outline is circular allows to exploit as best the available surface defined by the projection opening of the casing which is normally circular.

According to a preferred embodiment of the present invention, the optical elements of the perimeter assembly are shaped so as to define a polygonal outline of the emission area inscribed in a circumference. In this manner, by looking at the stage light fixture frontally, the observer perceives an emission area having an outline which approximates a circular outline, mainly at a given distance from the stage light fixture. Furthermore, the fact that the outline is inscribed in a circumference allows to exploit as best the available surface defined by the projection opening of the casing which is normally circular.

According to a preferred embodiment of the present invention, the optical elements of the perimeter assembly are provided with at least one curved side so as to define a circular outline of the emission area. The particular shape of the optical elements of the perimeter assembly allows to obtain an outline which cannot normally be obtained with optical elements of normal use (hexagonal lenses or round lenses).

According to a preferred embodiment of the present invention, the light sources are uniformly distributed within the emission outline. In this manner, the total light beam emitted by the plurality of sources and by the plurality of optical elements is uniform and does not comprise zones with different luminance.

According to a preferred embodiment of the present invention, the plurality of optical elements comprises at least one first assembly of optical elements arranged one next to the other along a first path and at least one second assembly of optical elements arranged one next to the other along a second path; at least one optical element of the first assembly having an emission face having a different shape with respect to the emission face of an optical element of the second assembly.

In this manner, the available surface can be exploited as best and at the same time the manufacturing costs of the optical elements can be minimized by seeking to use equal assemblies of optical elements, when possible.

According to a preferred embodiment of the present invention, the first path is circular and the second path is circular, concentric to the first path and within the first path. In this manner, the construction and the positioning of the optical elements is simplified. Furthermore, by virtue of this aspect, the available surface can be exploited as best and, at the same time, the manufacturing costs of the optical elements can be minimized by attempting to use assemblies of equal optical elements along circular paths, when possible. According to a preferred embodiment of the present invention, the optical elements of the plurality of optical elements have a polygonal-shaped emission face.

According to a preferred embodiment of the present invention, the plurality of optical elements comprises at least one lens and/or one assembly of lenses and/or one collimator and/or one reflector.

According to a preferred embodiment of the present invention, the stage light fixture according to the present invention comprises a casing having a first closed end and a second end provided with a substantially circular or elliptical section projection opening, which defines a projection area; the plurality of light sources being arranged inside the casing.

According to a preferred embodiment of the present invention, the emission area of the light beams is greater or equal to 75% of the projection area, preferably greater than or equal to 85% of the projection area, more preferably greater than or equal to 95% of the projection area.

BRIEF DESCRIPTION OF THE DRAWINGS

Further features and advantages of the present invention will be apparent in the following description of a non-limitative embodiment with reference to the figures in the accompanying drawings, in which.

BEST MODE FOR CARRYING OUT THE INVENTION

Figure 1:
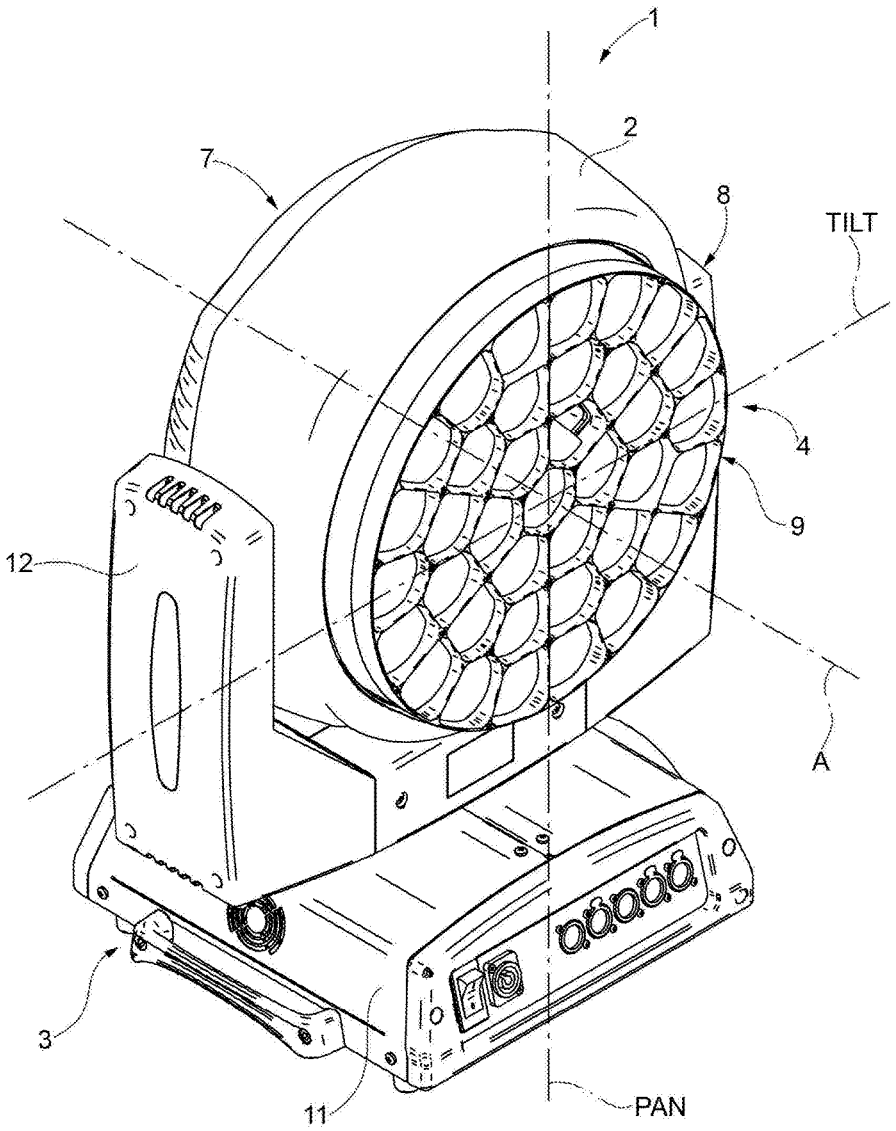
FIG. 1 is a perspective view, with parts removed for clarity, of a stage light fixture according to the present invention.

In FIG. 1, reference numeral 1 indicates a stage light fixture comprising a casing 2, supporting means 3, configured to support and actuate the casing 2, a plurality of light sources 4 (shown more clearly in FIGS. 2 and 3) and a plurality of optical elements 5.

The casing 2 extends along a longitudinal axis A and has a first closed end 7 and a second end 8, opposite to first closed end 7 along axis A, and provided with a projection opening 9. In the non-limiting example described and illustrated here, and the projection opening 9 has a substantially circular section and defines a circular-shaped projection area AP.

In a variant (not shown) the projection opening 9 has an elliptical, instead of circular, shape.

The supporting means 3 are configured to allow the casing 2 to rotate about two orthogonal axes, commonly named PAN and TILT axes. In particular, the supporting means 3 comprise a base 11 to which a fork 12 is coupled in rotational manner about the PAN axis. The fork 12 supports the casing 2 in rotational manner about the TILT axis.

The actuation of the supporting means 3 is regulated by a control device (not shown in the accompanying figures). The control device may be remotely managed also preferably by means of DMX protocol communications.

The plurality of light sources 4 is arranged inside the casing 2.

Figure 2:
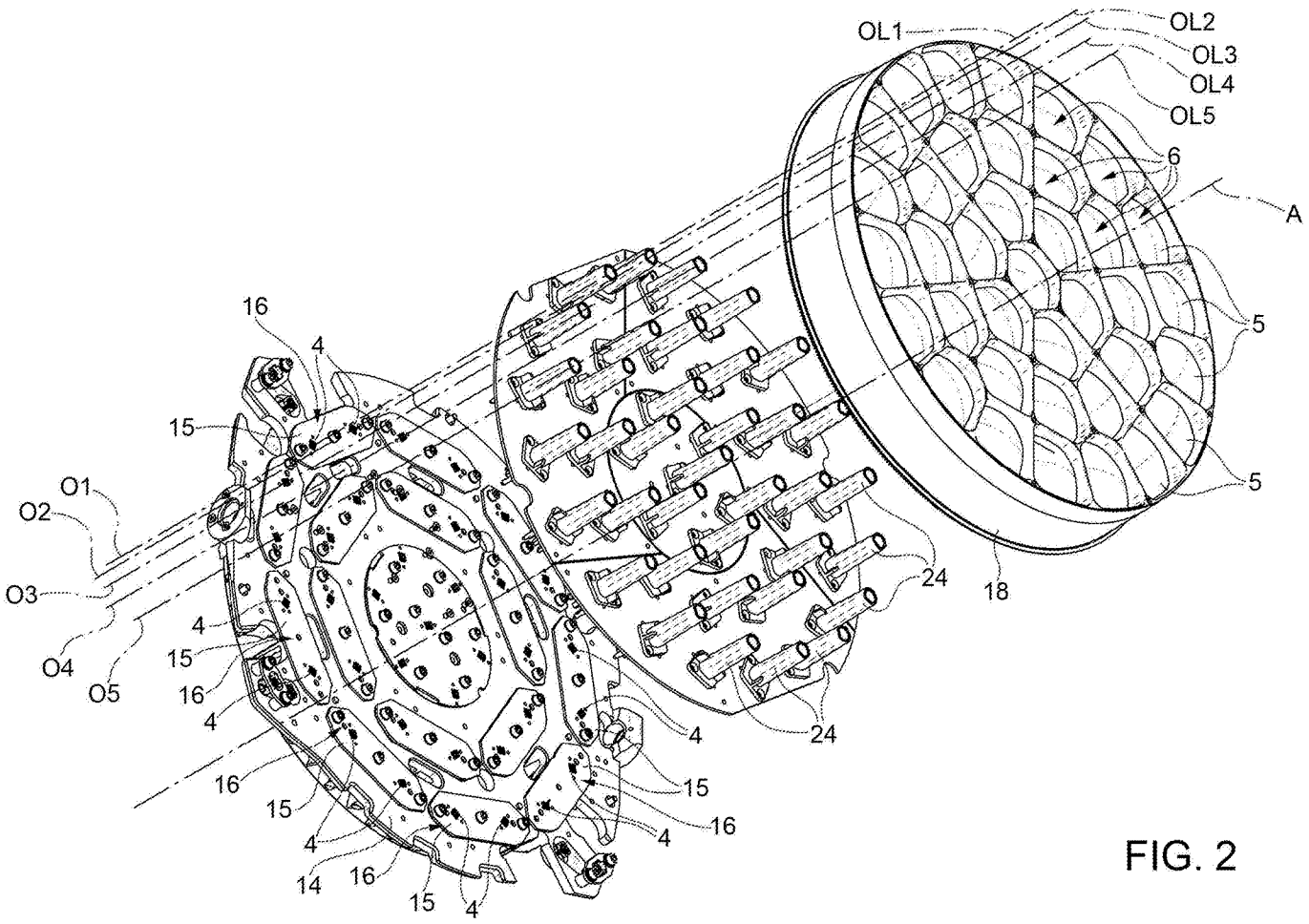
FIG. 2 is a diagrammatic exploded view, with parts removed for clarity, of a detail of the stage light fixture in FIG. 1.

With reference to FIG. 2, the light sources 4 are configured to emit the respective light beams along respective optical axes O1, O2, O3, O4 . . . On (not all axes are shown for the sake of simplicity).

In the non-limiting example described and illustrated here, there are thirty-seven light sources 4 and the optical axes O1, O2, O3, O4 . . . On are parallel to the axis of the stage light fixture A.

Indeed, the plurality of light sources 4 is supported by a supporting plate 14, which is coupled to a frame (not shown in the accompanying figures) integral with the casing 2 and arranged orthogonal to the axis A of the casing 2.

In detail, the light sources 4 are integrated in one or more electronic boards 15 (diagrammatically shown in FIG. 2), which are supported by the supporting plate 14 by means of a coupling system 16.

Preferably, the coupling system 16 is configured so as to allow, if required, to uncouple the electronic boards 15 in which the light sources 4 are integrated from the supporting plate 14 (e.g. to replace one or more light sources).

Preferably, the coupling system 16 comprises screws configured to fix the boards on which the light sources 4 are mounted to the supporting plate 14.

In the non-limiting example described and illustrated here, the light sources 4 are defined by LEDs (Light Emitting Diodes).

Preferably, the LEDs used in the stage light fixture according to the present invention are LEDs of the RGBW type.

Preferably, the light sources 4 are uniformly distributed along the supporting plate 14 so as to generate a plurality of uniformly distributed beams.

The optical elements 5 are arranged downstream of the light sources 4 along axis A of the casing 2 and are supported by a frame 18 coupled to the casing 2 near the second end 8.

Each optical element 5 is arranged so as to intercept the light beam of a respective light source 4.

Hereinafter, the expression "optical element 5" means an optical device configured to modify the direction of the rays of the light beam which hit it.

For example, the plurality of optical elements 5 may comprise lenses and/or an assembly of lenses and/or collimators and/or reflectors and/or prismatic elements.

In the non-limiting example described and illustrated here, each optical element 5 is defined by a lens, preferably plane-convex.

In a variant (not shown), each optical element 5 is defined by a Fresnel type lens.

Substantially, the expression "optical element" means an active element from the optical point of view capable of determining a variation of inclination of the light rays which hit the surface of the optical element.

Each optical element 5 comprises an inlet face (not shown in the accompanying figures), which faces towards the respective light source 4, and an emission face 6, opposite to the inlet face and characterized by its own emission area A1, A2, A3 capable of emitting light rays, the inclination of which was modified during the crossing of the optical element 5 itself.

In the non-limiting case described and illustrated here, the emission area of the optical elements 5 coincides with the extension of the emission face 6 of the optical elements 5 themselves, being the lens an emitting surface itself.

Each lens 5 is provided with a working optical axis OL1, OL2, OL3 . . . OLn.

In the non-limiting example described and illustrated here, there are thirty-seven lenses 5 and the working optical axes OL1, OL2, OL3, OL4 . . . OLn are parallel to the axis of the stage light fixture A.

Thus, a surface transparent to light rays cannot be considered an optical element because it cannot modify the direction of the light rays which hit it.

Figure 3:
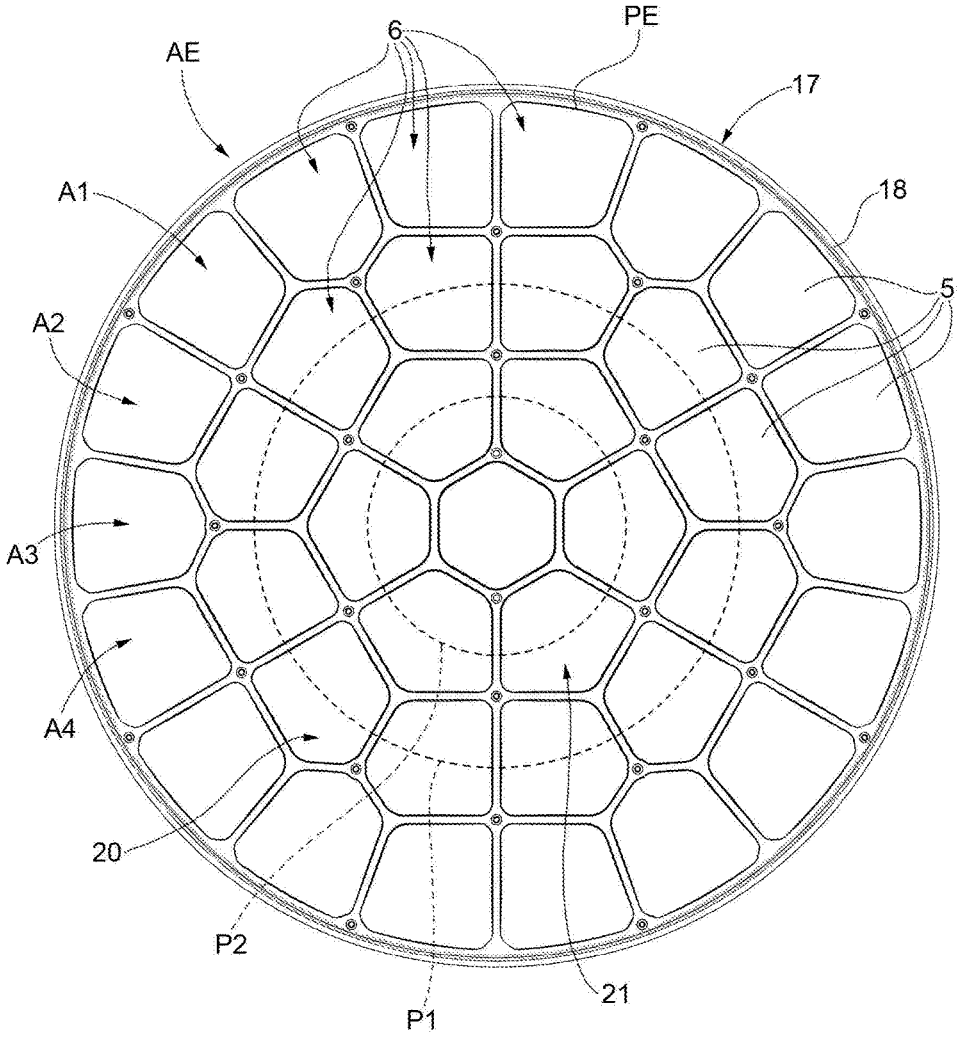
FIG. 3 is a diagrammatic front view, with parts removed for clarity, of a second detail of the stage light fixture in FIG. 1.

With reference to FIG. 3, the optical elements 5 are shaped and arranged one next to the other so as to define a total emission area AE of the light beams having an emission outline PE defined by a perimeter assembly 16 of lens.

The total emission area AE is thus defined as the sum of the emission areas A1, A2, A3 . . . An of each optical element 5.

The plurality of optical elements 5 comprises at least two optical elements 5 having respective emission faces 6 of different shape one with respect to the other.

In the non-limiting example described and illustrated here, the plurality of optical elements 5 comprises optical elements 5 having polygonal-shaped emission faces 6. In particular, the plurality of optical elements 5 comprises an optical element 5 having an hexagonal-shaped emission face 6, twenty-four optical elements 5 having a polygonal-shaped emission face 6, and twelve optical elements having a quadrangular-shaped emission face 6.

It is understood that the plurality of optical elements 5 may include optical elements 5 having emission faces 6 also of other shapes.

Substantially, the shape of the optical elements 5 is defined so that, once arranged one next to the other, the optical elements 5 define a total emission area AE which is as close to the projection area AP defined by the projection opening 9 as possible.

In particular, the shape of the emission faces 6 of the optical elements 5 is defined so that, once arranged one next to the other, the optical elements 5 define a total emission area AE of the light beams which is greater or equal to 80% of the projection area AP, preferably greater or equal than 85% of the projection area AP, preferably greater or equal to 95% of the projection area AP.

The plurality of optical elements 5 comprises at least one first assembly 20 of optical elements 5 arranged one next to the other along a first circular path P1 and one second assembly 21 of optical elements 5 one next to the other along a second circular path P2 concentric to the first path P1 and inside first path P1. At least one optical element 5 of the first assembly 20 having a shape of the emission face 6 different from the shape of the emission face 6 of at least one optical element 5 of the second assembly 21.

The frame 18 is shaped so as to support the optical elements 5 one next to the other according to the preferred arrangement. Preferably, the frame 18 is made so as to minimize the non-emitting areas present between one optical element 5 and the next. Preferably, the frame 18 comprises two flanges (not shown in accompanying figures) having substantially the same frame which can be coupled to one another. The optical elements 5 are arranged between the flanges. In this manner, the optical elements 5 are retained between the two coupled flange. This allows to avoid the use of coupling means which require to pierce or process the optical elements 5.

In a variant (not shown), the optical elements 5 are made in one piece. In this manner, the frame 18 will be coupled at the optical elements 5 of the perimeter assembly only, thus minimizing the non-emitting areas and increasing the extension of the total emission area AE.

With reference to FIG. 2, at least one light source 4 of the plurality of light sources 4 and the respective optical element 5 of the plurality of optical elements 5 are moveable one with respect to the other along a direction transversal to the optical axis O1, O2, O3, . . . On of the light source 4 and, preferably, also along a direction parallel to the optical axis O1, O2, O3, . . . On of the light source 4.

The relative movement between the light source 4 and the respective optical element 5 along a direction transversal to the optical axis O1, O2, O3, . . . On determines a variation of the main direction of the light beam emitted by the source assembly-optical element. Where the expression "main direction" hereinafter means the direction defined by the union of the center of gravity of an emitting surface defined at the optical element 5 with the center of gravity of a surface illuminated by the beam at a distance greater than 5 meters from the optical element 5.

The relative movement between the light source 4 and the respective optical element 5 along the optical axis O1, O2, O3, . . . On, instead, determines a variation of the width of the beam, meaning the opening angle of the beam itself. In this manner, the relative movement between the light source 4 and the respective optical element 5 along the optical axis O1, O2, O3, . . . On determines a zoom effect. In the non-limiting example described and illustrated here, the zoom effect provides a variation of the width of the opening angle of the beam which goes from a minimum of 4° (configuration in which the light beams projected by the optical elements are clearly distinguished one from the other) to a maximum of 60° (configuration in which all the light beams projected by the single optical elements are superimposed to form a single light beam).

In the non-limiting example described and illustrated here, the relative displacement between the light source 4 and the optical element 5 determines a misalignment between the optical axis O1, O2, O3, . . . On of the light source 4 and the optical axis O1, O2, O3, . . . On of the optical element 5. This determines a variation of the main direction of the light beam.

In the non-limiting example described and illustrated here, the plurality of light sources 4 is supported by the supporting plate 14 and is preferably distributed along a first plane, while the plurality of optical elements 5 is supported by the frame 18 and is preferably distributed along a second plane.

The plurality of light sources 4 and the plurality of optical elements 5 rotate one with respect to the other on parallel planes.

Preferably, the frame 18 is rotatable with respect to supporting plate 14 by virtue of actuating means (not shown for the sake of simplicity in the accompanying figures).

In the non-limiting example described and illustrated here, the frame 18 can perform a complete 360° rotation. Preferably, the frame 18 may rotate in both directions. More preferably, the frame 18 may rotate at variable speed.

The activation of the actuating means of the frame 18 is controlled by the control device (not shown). As previously mentioned, the control device may be managed also remotely preferably by means of DMX protocol communications.

The actuation controlled by the actuating means allows to adjust the degree of rotation, the rotation speed and the rotation direction of the plurality of optical elements. In this manner, a plurality of different stage effects can be obtained.

In the non-limiting example described and illustrated here, each light source 4 is further coupled to a respective mixer device 24. The mixer device 24 is configured to collect the light beam emitted by the respective light source 4 and to mix it appropriately so as to generate a mixed and concentrated light beam.

In particular, the mixer device 24 has an elongated prismatic shape and extends along the optical axis O1, O2, . . . On of the light beam of the light source 4 to which it is coupled.

It is finally apparent that changes and variations may be made to the stage lighting fixture described herein without departing from the scope of protection of the accompanying claims.

The invention claimed is:

1. A stage light fixture comprising:

a plurality of light sources configured to emit respective light beams along respective optical axes;

a plurality of lenses, each of which is configured to modify the direction of the rays of the light beam of a respective light source;

each lens being provided with an inlet face, which faces towards the respective light source, and with an emission face, opposite to the inlet face and characterized by its own emission area capable of emitting light rays;

the lenses being shaped and arranged one next to the other so as to define a total emission area of the light beams having an emission outline; the plurality of lenses comprises at least two lenses having respective emission faces having different shape one from the other;

wherein the plurality of lenses comprises at least a first assembly of lenses arranged one next to the other along a first path and a second assembly of lenses arranged one next to the other along a second path; wherein the first path is circular and the second path is circular, concentric to the first path, and arranged inside the first path; at least one lens of the first assembly having an emission face having a shape different from the emission face of at least one lens of the second assembly; wherein the lenses of the plurality of lenses have a polygonal-shaped emission face; and a plurality of mixer devices disposed between the plurality of light sources and the plurality of lenses, each mixer device being axially aligned relative to one respective light source and one respective lens along one respective optical axis of the respective light beam and each mixer device configured to act on the respective light beam prior to the respective light beam contacting the respective lens.

2. The stage light fixture according to claim 1, wherein the plurality of lenses comprises a perimeter assembly of optical elements arranged one next to the other to define the emission outline of the total emission area.

3. The stage light fixture according to claim 1, wherein the lenses of the perimeter assembly are shaped so as to define an emission outline of the total emission area proximate to a circumference.

4. The stage light fixture according to claim 1, wherein the lenses of the perimeter assembly are shaped so as to define an emission outline of the total emission area which is polygonal and inscribed in a circumference.

5. The stage light fixture according to claim 1, wherein the lenses of the perimeter assembly are provided with at least one curved side so as to define a circular emission outline of the total emission area.

6. The stage light fixture according to claim 1, wherein the light sources are uniformly arranged inside the emission outline.

7. The stage light fixture according to claim 1, comprising a casing having a first closed end and a second end provided with a projection opening, which defines a projection area; the plurality of light sources being arranged inside the casing.

8. The stage light fixture according to claim 7, wherein the total emission area of the light beams is greater or equal to the 80% of the projection area.

9. The stage light fixture according to claim 1, wherein at least one light source of the plurality of light sources and the respective lens of the plurality of lenses are movable one with respect to the other along a direction transversal to the optical axis of the light source.

10. The stage light fixture according to claim 1, wherein at least one light source of the plurality of light sources and the respective lens of the plurality of lenses are movable one with respect to the other along a direction parallel to the optical axis of the light source.

11. The stage light fixture according to claim 1, wherein the plurality of light sources and the plurality of lenses rotate one with respect to the other on parallel planes.

12. The stage light fixture according to claim 7, wherein the total emission area of the light beams is greater or equal to 85% of the projection area.

13. The stage light fixture according to claim 7, wherein the total emission area of the light beams is greater or equal to 95% of the projection area.

14. The stage light fixture according to claim 1, wherein each mixer device is configured to collect the light beam emitted by the respective light source and mix the light beam to generate a mixed and concentrated light beam that is delivered to the respective lens.

15. The stage light fixture according to claim 1, wherein the mixer device has an elongated prismatic shape that extends along the respective optical axis of the light beam of the light source to which the mixer device is coupled.

16. A stage light fixture comprising:

a plurality of light sources configured to emit respective light beams along respective optical axes;

a plurality of lenses, each of which is configured to modify the direction of the rays of the light beam of a respective light source;

each lens being provided with an inlet face, which faces towards the respective light source, and with an emission face, opposite to the inlet face and characterized by its own emission area capable of emitting light rays;

the lenses being shaped and arranged one next to the other so as to define a total emission area of the light beams having an emission outline; the plurality of lenses comprises at least two lenses having respective emission faces having different shape one from the other;

wherein the plurality of lenses comprises at least a first assembly of lenses arranged one next to the other along a first path and a second assembly of lenses arranged one next to the other along a second path; at least one lens of the first assembly having an emission face having a shape different from the emission face of at least one lens of the second assembly; and a plurality of mixer devices disposed between the plurality of light sources and the plurality of lenses, each mixer device being axially aligned relative to one respective light source and one respective lens along one respective optical axis of the respective light beam and each mixer device configured to modify the respective light beam prior to the respective light beam contacting the respective lens.

17. The stage light fixture according to claim 16, wherein each mixer device is configured to collect the light beam emitted by the respective light source and mix the light beam to generate a mixed and concentrated light beam that is delivered to the respective lens.

18. The stage light fixture according to claim 16, wherein the mixer device has an elongated prismatic shape that extends along the respective optical axis of the light beam of the light source to which the mixer device is coupled.

* * * * *